US007934440B2

(12) United States Patent
Samudosky

(10) Patent No.: US 7,934,440 B2
(45) Date of Patent: May 3, 2011

(54) POWERED WRENCH

(76) Inventor: Vincent Martin Samudosky, West Mifflin, PA (US)

( * ) Notice: Subject to any disclaimer, the term of this patent is extended or adjusted under 35 U.S.C. 154(b) by 311 days.

(21) Appl. No.: 12/277,149

(22) Filed: Nov. 24, 2008

(65) Prior Publication Data

US 2009/0078091 A1 Mar. 26, 2009

Related U.S. Application Data

(63) Continuation-in-part of application No. 11/881,552, filed on Jul. 27, 2007, now abandoned.

(51) Int. Cl.
*B25B 21/00* (2006.01)

(52) U.S. Cl. ..... 81/57.29; 81/57.13

(58) Field of Classification Search ..... 81/57.11–57.14, 81/57, 57.28–57.31, 57.45–57.46
See application file for complete search history.

(56) References Cited

U.S. PATENT DOCUMENTS

| | | | | |
|---|---|---|---|---|
| 858,892 | A | 7/1907 | Moss | |
| 858,894 | A | 7/1907 | Moss | |
| 1,346,716 | A * | 7/1920 | Lee | 81/57.29 |
| 1,698,618 | A * | 1/1929 | Bigelow | 81/57.29 |
| 2,787,180 | A | 4/1957 | Fish | |
| 3,124,022 | A | 3/1964 | Corson | |
| 3,272,037 | A | 9/1966 | Bruehl | |
| 4,043,228 | A * | 8/1977 | Venezio | 81/57.3 |
| 4,627,310 | A * | 12/1986 | Coburn | 475/270 |
| 5,125,297 | A * | 6/1992 | Bai et al. | 81/57.31 |
| 5,557,991 | A * | 9/1996 | Brodbeck | 81/57.29 |
| 5,616,095 | A * | 4/1997 | Pruitt | 475/178 |
| 5,630,343 | A | 5/1997 | Begin | |
| 6,305,236 | B1 | 10/2001 | Sturdevant | |
| 2001/0039857 | A1 | 11/2001 | Sturdevant | |

* cited by examiner

*Primary Examiner* — D. S Meislin

(74) *Attorney, Agent, or Firm* — Lawrence E. Lambelet, Jr.

(57) ABSTRACT

The problem of reaching a work piece, such as a nut on a bolt, in a restricted space not permitting traditional means of applying torque is addressed with a powered wrench. The wrench translates motor power on one axis to an engageable socket on a perpendicular axis through an innovative gearbox. Means are provided to shift from a gear ratio for power to a gear ratio for speed by simple manipulation, while different size work pieces can be accommodated through socket change parts.

12 Claims, 6 Drawing Sheets

POWERED WRENCH

CROSS-REFERENCE TO RELATED APPLICATIONS

This continuation-in-part application is filed under 37 CFR 1.53 and claims benefit under 35 USC 120 to nonprovisional application Ser. No. 11/881,552, filed Jul. 27, 2007, now abandoned.

FIELD OF THE INVENTION

The present invention relates to the general art of tools, and to the particular field of wrenches.

BACKGROUND OF THE INVENTION

Many businesses, such as automobile repair shops, routinely encounter work pieces, such as bolts, nuts or the like, that are extremely difficult to remove or place. The difficulty can be a result of the work piece being fixed-in-place, as by rust or over tightening, or because the work piece is in a location that is difficult to reach. For example, a bolt may be underneath another part that blocks access to it or otherwise inhibits the swinging action of a handle of a tool, such as wrench, while engaging it and applying torque. This makes removal or installation of certain work pieces difficult and time consuming.

It is often necessary to remove blocking parts to gain access to the work piece of interest with a wrench, such as an open-end or a box-end wrench. There is a need for a wrench that can expeditiously reach and remove work pieces and not require surrounding space for manipulation of the lever-handle. There is also a need to apply sufficient torque without exhaustive human effort. One solution is a powered wrench, wherein torque is supplied to the work-piece-engaging part of the wrench by a motor.

Such a powered wrench would have a gearbox for transmitting the power. One requirement would be for the gearbox profile to be as small as possible to navigate tight spaces. Another requirement would be for the power to be transmitted through the handle; or, in other words, perpendicular to the axis of the work-piece-engaging part of the wrench. Both requirements are met by a worm gearbox.

In a worm gearbox, a screw transmits power to a spur gear. The axes of the screw, or worm, and the spur gear are perpendicular. Such an arrangement is typically smaller than other configurations having the same gearing ratio and involving multiple spur gears. Sometimes the gear train includes an intermediate, or idler, gear between the worm gear and the spur gear doing the work, or drive gear. This configuration allows different spatial arrangements of the gear system.

As known in the art, it takes a complete revolution of the worm gear to advance the drive gear one tooth. A 30-tooth drive gear, for example, would have a 30:1 reduction in speed and a complementary 30:1 increase in torque. It should be noted that the idler gear is inconsequential with respect to the gear ratio since it transmits motion but does not contribute any mechanical advantage. This low-speed-high-torque gearing arrangement is particularly well matched to motor drives, which drives characteristically produce high revolution speed with low torque.

Worm gear configurations for powered wrenches are known in the art. For example, in U.S. Pat. No. 6,543,313 to Samudosky et al, a prior patent of the instant inventor which is incorporated herein by reference, a worm gearing arrangement driving a chain sprocket is disclosed. The chain provides an adaptable means for engaging the work piece. The chain, however, is subject to breakage and, on occasion, slippage.

U.S. Pat. No. 858,892 to Moss teaches a worm gearing arrangement to drive a spur gear with a box recess to engage a nut. The box recess provides a firm and virtually unbreakable grip on the work piece. Adaptation to smaller work pieces is provided by inserts to the box recess similar to socket-wrench sockets. Moss uses an idler gear to make the layout compact for tight spaces. The drive force, however, is supplied by twisting the handle by hand and is not supplied by motor. This twisting can be fatiguing for the operator, particularly considering the slow speed of the operation.

Considering that higher torque is usually only needed in the initial loosening of a work piece, such as a nut, and that the subsequent unthreading of the nut following its loosening is characterized by lower frictional forces, it would be desirable to have a means to switch from high torque to lower torque, and, in doing so, to hasten the speed of the action. Furthermore, not all work pieces require the same initial "breaking" torque. However, a wrench designed to be powerful enough for the occasional "frozen" nut, will of necessity be slow in operation. What is needed in such cases is a dual-speed option.

U.S. Pat. No. 3,272,037 to Bruehl describes a wrench having dual speeds. The slow speed is provided in a manner similar to Moss above. The fast speed is provided by a ratchet mechanism enabling the handle to be used in the conventional way, that is, by swinging the handle by hand. This does not solve the problem for a restricted space, however, because there would be insufficient room to swing the handle.

What is missing in the prior art is a gear-driven motor-powered wrench for fitting into tight spaces with a changeable gear ratio providing both slow and fast speeds.

BRIEF SUMMARY OF THE INVENTION

In view of the above-mentioned unfulfilled needs in the prior art, the present invention embodies the objects and advantages detailed herein:

A first object of the present invention is to provide a powered wrench for tight spaces where room for conventional handle-action is restricted.

A second object of the present invention is to provide a powered wrench having a socket engagement to securely grip a work piece.

A third object of the present invention is to provide a socket engagement adaptable to different sized and shaped work pieces.

A fourth object of the present invention is to provide a 60:1 gear ratio for low speed and high torque.

A fifth object of the present invention is to provide a 30:1 gear ratio for high speed and low torque.

A sixth object of the present invention is to provide a means for switching between gear ratios without disassembly of the wrench.

In a preferred embodiment of the present invention, a powered wrench comprises a housing having a handle part and a gear part. The handle part has a longitudinal extent with a worm gear mounted therein, the worm gear having a shaft extending through the handle part to connect to a remote motor drive. A bore extends through the gear part of the housing such that the axis of the bore is perpendicular to the axis of the shaft.

A means for gearing is housed in the gear part and connected to the worm gear through a means for connecting. The means for gearing is comprised of a first gear ratio, a second gear ratio and a means for shifting therebetween. The first gear ratio represents a power mode and the second gear ratio, a speed mode of operation. A means for engaging a work piece through the bore is connected to the means for gearing.

In another aspect of the preferred embodiment, a method of using the powered wrench comprises the steps of connecting to the motor, engaging the work piece, selecting the first gear ratio, applying power to loosen the work piece, selecting the second gear ratio, and applying power again to remove the work piece quickly.

BRIEF DESCRIPTION OF THE SEVERAL VIEWS OF THE DRAWING(S)

Various other objects, features and attendant advantages of the present invention will become fully appreciated as the same becomes better understood through the accompanying drawings, in which like reference characters designate the same or similar parts throughout the several views, and wherein.

DETAILED DESCRIPTION OF THE INVENTION

Figure 1:
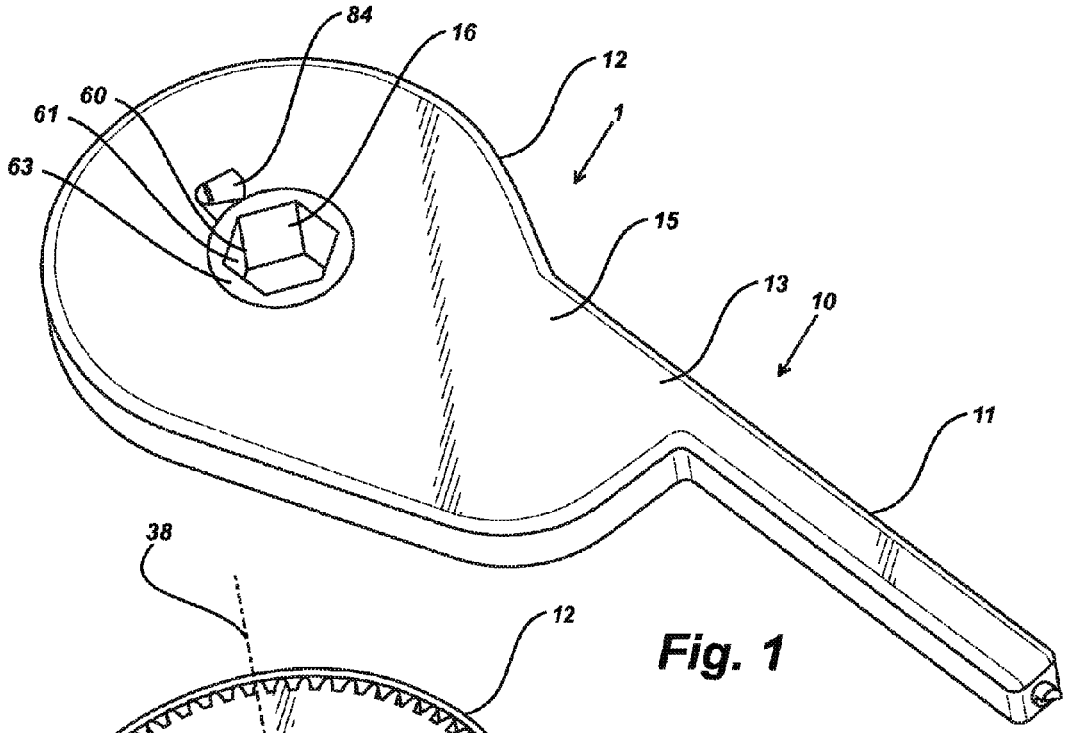
FIG. 1 is a perspective view of the powered wrench from the top.
Figure 2:
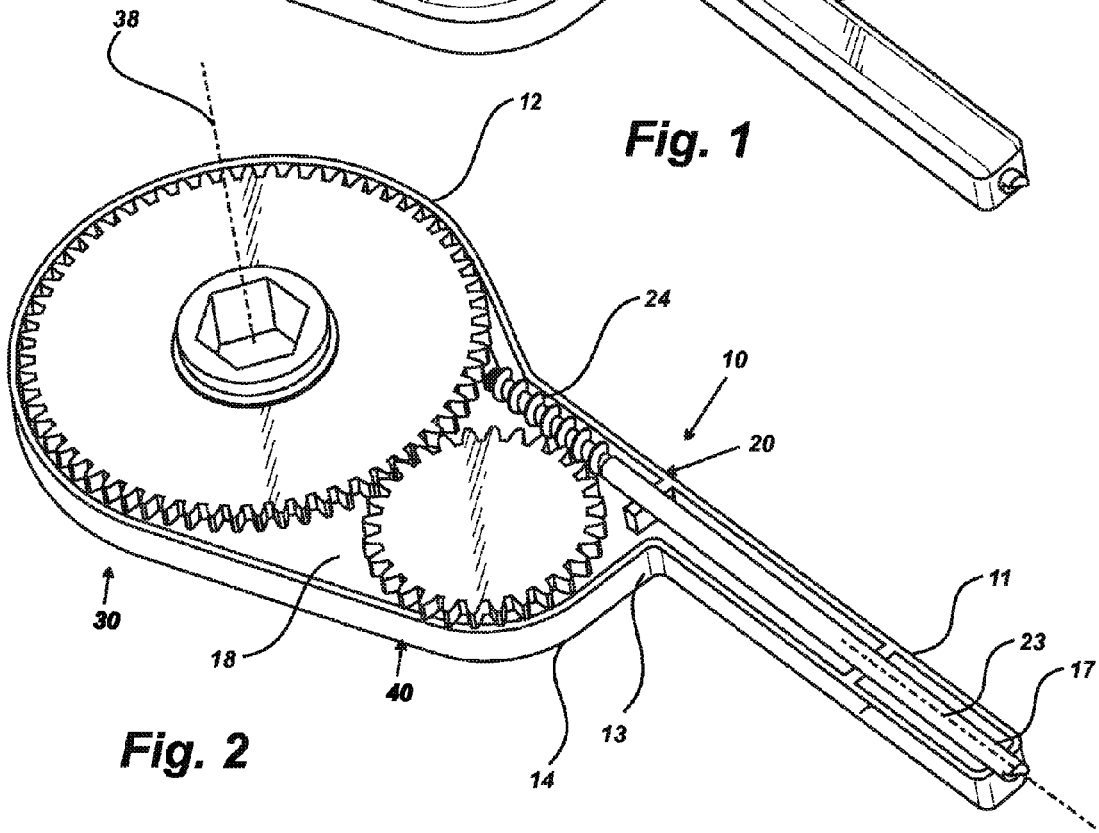
FIG. 2 is an inside perspective view showing the gears in engagement for the first, or power, gear ratio.

FIGS. 1 and 2 show the principal components of the assembled powered wrench 1. Housing 10 is divided into a handle part 11 and a gear part 12. Housing 10 is further sectioned by cover part 15 and base part 14, the cover and base parts providing a means for accessing 13 an interior space 18. Interior space 18 is revealed in FIG. 2, where cover part 15 has been removed. Positioned in interior space 18 is a means for gearing 30, a means for connecting 40, and a shaft 20. The gear part 12 has a bore 16 extending through both cover part 15 and base part 14.

Figure 3:
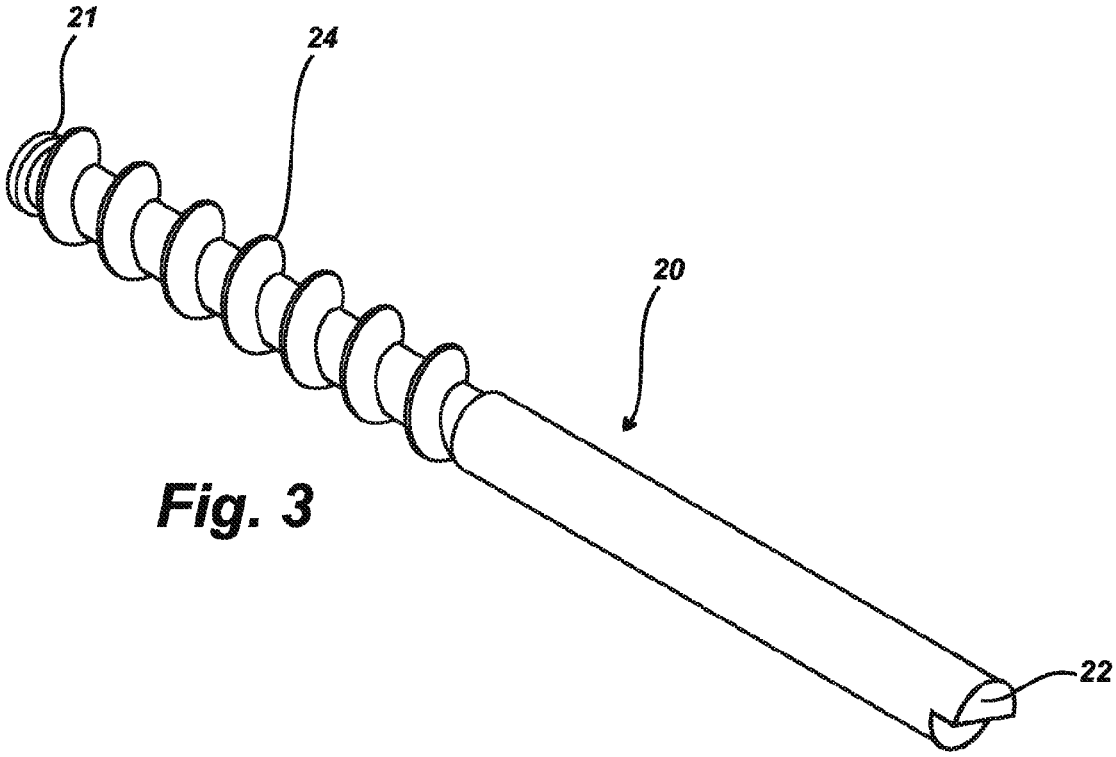
FIG. 3 is a truncated perspective view of the worm gear and shaft.

Referring to FIG. 3, shaft 20 has a proximal end 21 and a distal end 22. A worm gear 24 is positioned at proximal end 21 and extends into gear part 12. Distal end 22 connects to motor drive 25 (not shown). Shaft 20 is rotatably mounted in handle part 11, best shown in FIG. 2, and has a first axis of rotation 23 which is coincident with a longitudinal axis 17 of the handle part.

Figure 5:
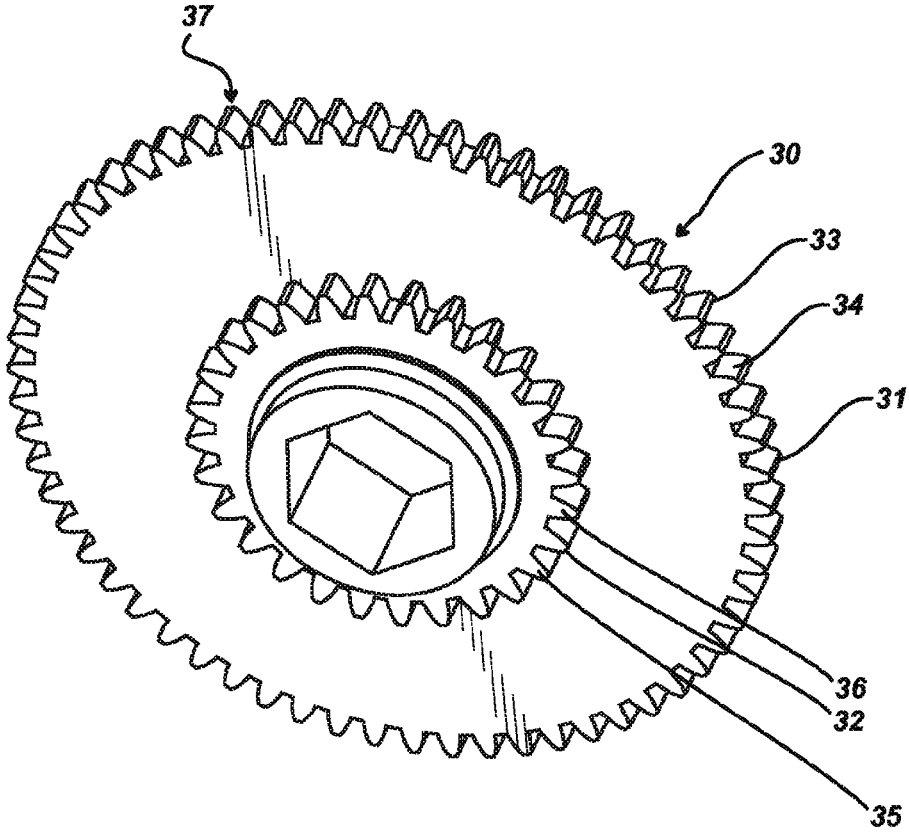
FIG. 5 is a perspective view of the gear stack from the bottom showing the first and second spur gears.
Figure 6:
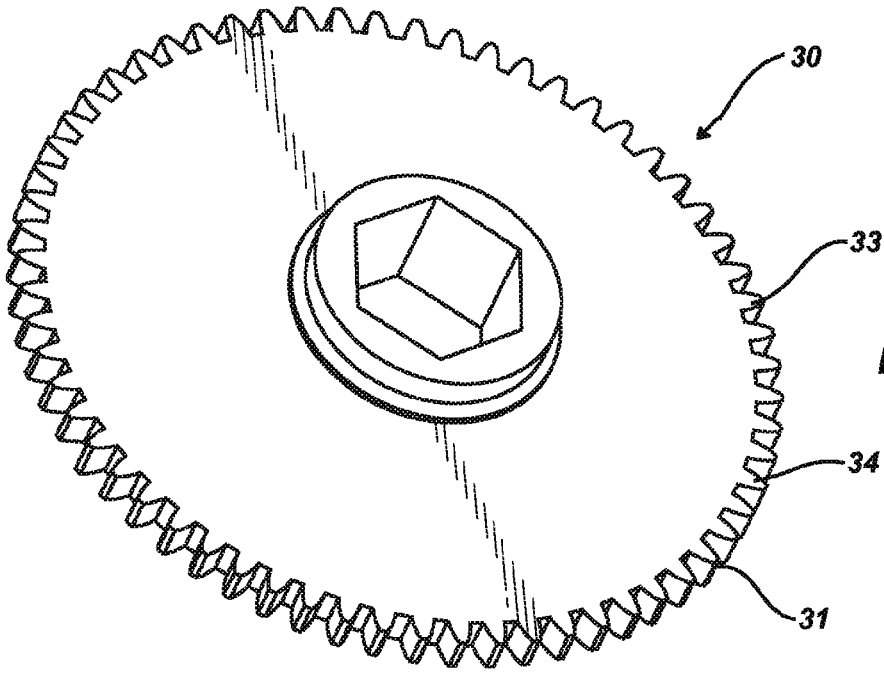
FIG. 6 is a perspective view of the gear stack from the top showing the first spur gear and one of the hub protrusions.

The means for gearing 30 is best detailed in FIGS. 5 and 6. A first spur gear 33, having a first number of teeth 34 defining a first gear ratio 31, is coaxially joined in gear stack 37 with a second spur gear 35, having a second number of teeth 36 defining a second gear ratio 32. The gear stack 37 has a second axis of rotation 38, best shown in FIG. 2, which is perpendicular to the first axis of rotation 23. In a preferred embodiment, the first number of teeth is 60 and the first gear ratio, defining a power mode, is 60:1. Further, the second number of teeth is 30 and the second gear ratio, defining a speed mode, is 30:1.

Figure 4:
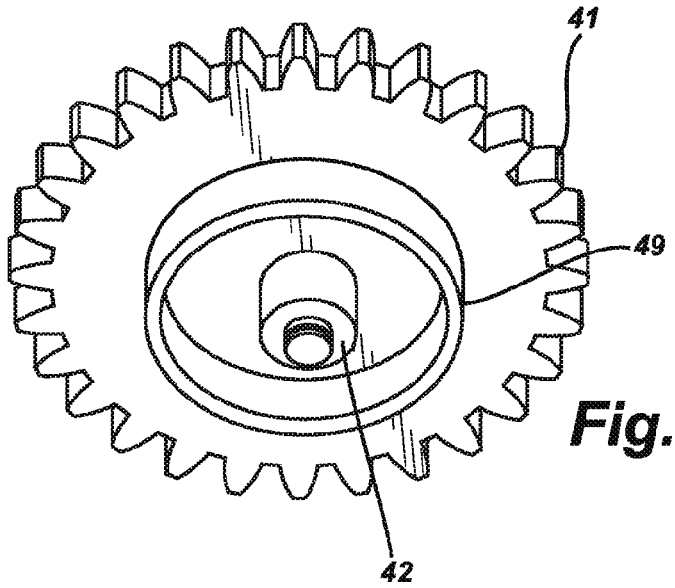
FIG. 4 is a perspective view of the idler gear from the bottom showing the spindle.

The means for gearing 30 is in meshing engagement with worm gear 24 through means for connecting 40, best shown in FIG. 4. The means for connecting 40 comprises idler gear 41 with a protuberant spindle 42 at its center. Rail 43 registers the elevation of idler gear 41 above base part 14, to which idler gear 41 is rotatably and moveably connected. Rail 43 additionally provides a reduced contact surface for rotating purposes. In connecting, spindle 42 extends through a slot 19 in base part 14, best shown in FIG. 7, and can move therein from one end of slot 19 to the other. Slot 19 has a longitudinal aspect parallel to longitudinal axis 17. Idler gear 41 remains in meshing contact with worm gear 24 throughout the movement in slot 19. Idler gear 41 can have any number of teeth, but is shown in the preferred embodiment as having 30. Idler gear 41 transfers the rotation from first axis of rotation 23 perpendicularly into rotation on second axis of rotation 38, as may be known in the art for worm gearboxes, while transferring power from worm gear 24 to one of spur gear 33 or spur gear 34. The spatial adjustment to the spur gears is achieved by translational movement of idler gear 41 in slot 19. The enmeshment of worm gear 24, idler gear 41 and first spur gear 33 is best shown in FIG. 2.

Figure 8:
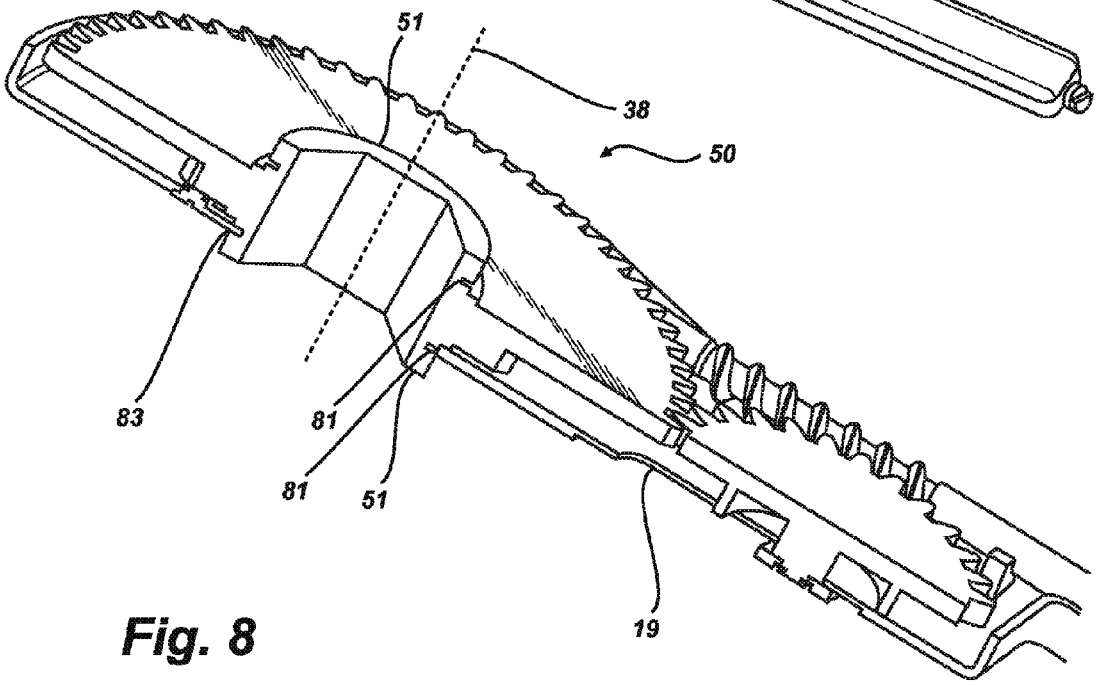
FIG. 8 is a partial sectional inside perspective view showing the gears in engagement for the first, or power, gear ratio.
Figure 9:
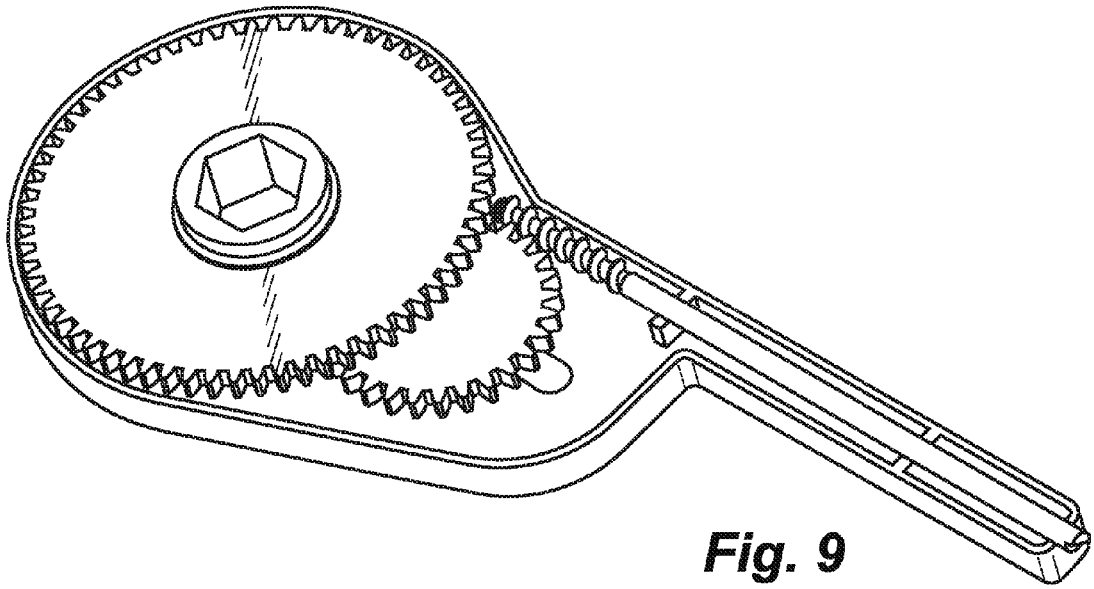
FIG. 9 is an inside perspective view showing the gears engaged for the second, or speed, gear ratio.
Figure 11:
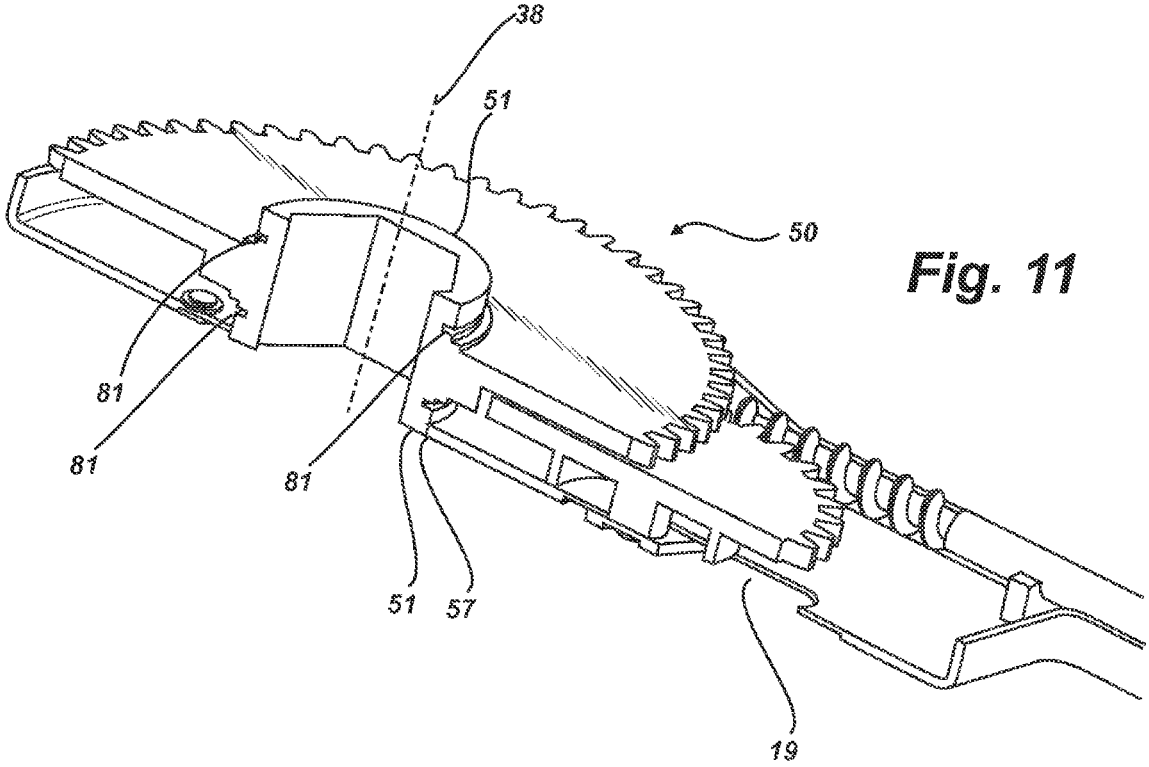
FIG. 11 is a partial sectional inside perspective view showing the gears in engagement for the second, or speed, gear ratio.

FIGS. 8 and 11 illustrate a means for shifting 50 between the first gear ratio 31 and the second gear ratio 32. Hub protrusions 51 extend from gear stack 37 in both directions along second axis 38. Hub protrusions 51 extend sufficiently to traverse bore 16 and protrude though both cover part 15 and base part 14 at all times, including when they have shifted along second axis 38. Hub protrusions 51 are slidingly fixtured by sidewalls 52 of the cover and base parts, the sidewalls framing bore 16. The translational movement of gear stack 37 along second axis 38 guided by hub protrusions 51 in sidewalls 52 shifts between the engagement of first spur gear 33 with idler gear 41 and the engagement of second spur gear 35 and idler gear 41. This translational movement can be accomplished by pushing on the most protrubing of the hub protrusions 51 with hand-applied pressure. The engagement of first spur gear 33 with idler gear 41 located at one end of slot 19 is shown in FIGS. 2 and 8, and the engagement of second spur gear 35 with idler gear 41 located at the other end of slot 19 is shown in FIGS. 9 and 11.

Figure 7:
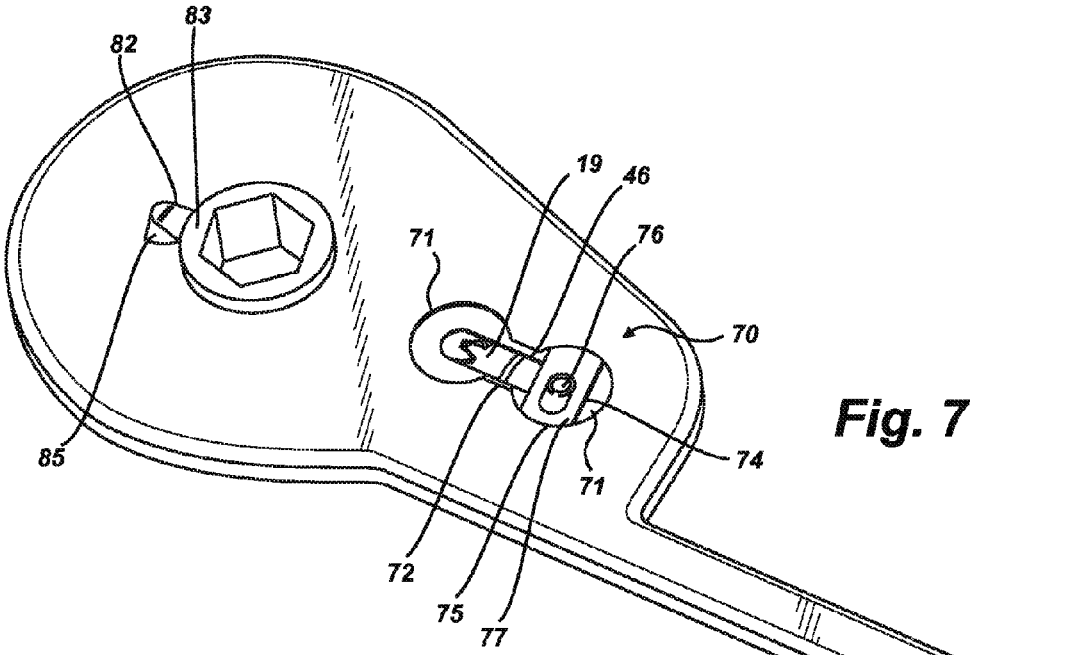
FIG. 7 is a perspective view of the bottom showing the first and second means for locking in position for the first gear ratio.
Figure 10:
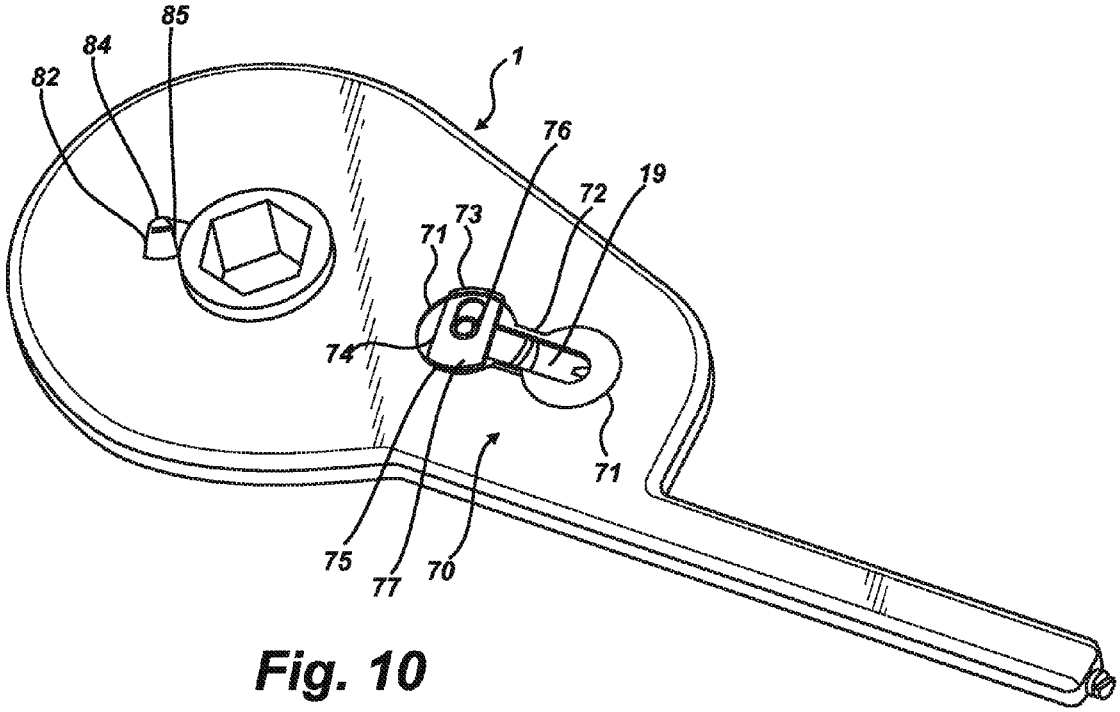
FIG. 10 is a perspective view of the bottom showing the first and second means for locking in position for the second gear ratio.

A means for engaging 60 to a work piece 2 (not shown) is illustrated in FIG. 1. A socket aperture 61 extends along second axis 38 through hub protrusions 51 and gear stack 37 to form engagement head 63. Engagement head 63 turns in a clockwise direction on one side of powered wrench 1 and turns in a counterclockwise direction on the other side. Thus reversal of action can be achieved without a reversible motor by flipping the powered wrench over. Socket aperture 61 is configured for a commonly-used work piece profile. Other work pieces can be accommodated through a plurality of socket inserts 62 (not shown) with structures that engagingly fit into socket aperture 61, common in the art of wrench sockets, and are configured to alternate work piece profiles. Because both the means for gearing 30 and the means for connecting 40 are moveable, some means for locking positions is required to maintain gear contact. Accordingly, means for connecting 40 is provided with a first means for locking 70, as shown in FIGS. 7 and 10, where the bottom of base part 14 is facing. One of two recesses 71 in the exterior of base part 14 is centered at each end of slot 19. A channel 72 provides a communicating link between the two recesses. A bar 73 is rotatably attached to spindle 42 by any known means, for example, a clevis pin 76, and thereby slidingly secures idler gear 41 in slot 19 with rail 43 riding on an inside surface of base part 14 and bar 73 riding within the two recesses 71 and channel 72. The bar 73 has a long dimension 74 and a short dimension 75, which latter dimension is broader than slot 19. Each of the two recesses 71 has a diameter substantially matching the long dimension 74, such that bar 73 is rotatable within the recess. Also, channel 72 has a width substantially matching the short dimension 75, such that the bar can pass through the channel. The idler gear 41 is moveable in slot 19 parallel to the longitudinal axis 17 when bar 73 is in align position 78 (not shown), characterized by the longitudinal alignment of bar 73 and channel 72. Alternatively, idler gear 41 is locked in position at either extreme of slot 19 when bar 73 is in lock position 77, characterized by the rotation of bar 73 out of alignment in one of the two recesses 71. The lock position 77 corresponding to the engagement of the first spur gear 33 is shown in FIG. 7, and the lock position 77 corresponding to the alternative engagement, that of second spur gear 35, is shown in FIG. 10.

Means for shifting 50 is similarly provided with a second means for locking 80. Annular slots 81 are located at the peripheries of hub protrusions 51, such that at least one of the annular slots 81 is exposed to the exterior of housing 10 when gear stack 37 is shifted for a change of gears. Annual slots 81 are best shown FIGS. 8 and 11. A pair of latches 82 is rotatably mounted to the exterior surfaces of cover part 15 and base part 14 such that the latches can be rotating into interposition with the annual slots 81 when the latter is shifted into proximity. The pair of latches 82 is nested in latch cavities 85 where the configuration of the cavities limit the rotation of the latches between an interlock position 83 and a disengage position 84. The interlock position 83 is characterized by the engagement of one of the pair of latches 82 in the one of the annular slots 81 in juxtaposition to it, the other of the pair of latches 82 occupying the disengage position. The pair of latches 82 and the latch cavities are best shown in FIGS. 7 and 10. The lock position 83 is best shown in FIGS. 7 and 8, while the disengage position 84 is shown in FIGS. 1 and 10. The lock position 83 is further characterized by a sense of rotation, that is to say, clockwise or counterclockwise, that matches the sense of the worm gear 24. It this were otherwise, the rotation of the gear stack would throw the engaged latch to the disengage position.

Thus it can be seen that a powered wrench, driven by a motor through connecting means for gearing, can apply torque through a means for engaging to variable work pieces in one of two scenarios, the first representing higher torque and lower speed and the second representing lower torque and higher speed, by selecting different gear ratios through a means for shifting accessible from the exterior of the powered wrench.

The housing components of the powered wrench may be comprised of any tough injection-molded thermoplastic material or any metal. In the preferred embodiment, the material of choice is ABS. The gears may be comprised of steel and fabricated by machining. The gears are machined tool steel in the preferred embodiment. The remaining components may be either of metal or plastic composition and fabricated by stamping or molding.

It is to be understood that the invention is not limited in its application to the details of construction and to the arrangements of the components set forth in the preceding description or illustrated in the drawings. The invention is capable of other embodiments and of being practiced and carried out in various ways. Also, it is to be understood that the phraseology and terminology employed herein are for the purpose of the description and should not be regarded as limiting.

What is claimed is:

1. A powered wrench, comprising:

a housing having a handle part, a gear part, an interior space, and a means for accessing the interior space, the gear part having a bore therethrough;

a shaft rotatably mounted in the interior space of the handle part having a proximal end, a distal end, and a first axis of rotation, the distal end connected to a motor drive, the proximal end forming a worm gear extending into the gear part;

a first spur gear in the interior space of the gear part having a first number of teeth defining a first gear ratio appropriate for the application of power joined in a gear stack with a second spur gear having a second number of teeth defining a second gear ratio appropriate for the application of speed, the worm gear selectively engaged through a means for moveably connecting with one of the first or second spur gears, the gear stack having a second axis of rotation extending through the bore perpendicular to the first axis of rotation, the gear stack translatable along the second axis of rotation from a first position where one of the first or second spur gears is engaged to a second position where the other spur gear is engaged;

a means for shifting between the first position and the second position; and a means for engaging a work piece connected to the gear stack;

whereby torque supplied by the motor and transmitted through the worm gear, the means for connecting, and the gear stack is applied to the work piece at a preferred speed governed by a selected gear ratio.

2. The powered wrench of claim 1, wherein the means for accessing the interior space is a division of the housing into a base part and a removable cover part, the base part having a slot therethrough, the slot having a longitudinal aspect parallel to the shaft.

3. The powered wrench of claim 2, wherein the means for moveably connecting is an idler gear having a spindle, the idler gear in meshing connection with the worm gear and either of the first and second spur gears through corresponding positions defined by the two ends of the slot, the spindle rotatably and moveably fixturing the idler gear in the slot, the movement between the two ends of the slot characterized by continuous contact with the worm gear, the spindle further having a first means for locking.

4. The powered wrench of claim 3, wherein the means for shifting is a pair of hub protrusions extending in opposite directions from the gear stack along the second axis of rotation, the hub protrusions traversing the bore in which they are rotatably fixtured by surrounding housing sidewalls in the base and cover parts, the extensions of the hub protrusions sufficient to maintain contact with the sidewalls during an axial shift from the meshing engagement of one of the first and second spur gears with the idler gear positioned at one end of the slot to the meshing engagement of the other of the first and second spur gears with the idler gear positioned at the other end of the slot, the hub protrusions further having a second means for locking.

5. The powered wrench of claim 4, wherein the means for engaging a work piece is a socket coaxial with the second axis of rotation and extending throughout the hub protrusions, the socket having an opening contour matched to a preferred work piece profile.

6. The powered wrench of claim 5, further comprising a means for adapting the socket to alternate work piece profiles.

7. The powered wrench of claim 6, wherein the means for adapting is an insert configured to the opening of the socket and having an opening therein configured to an alternate work piece profile.

8. The powered wrench of claim 3, wherein the first means for locking comprises a bar rotatably attached to the spindle, the bar having a long dimension and a short dimension, the short dimension wider than the slot, the bar additionally moveable within two recesses in the exterior surface of the base part centered over each of the two ends of the slot, the two recesses each having a diameter matching the long dimension of the bar, the two recesses communicating through a channel in the exterior surface, the channel having a width matching the short dimension of the bar, whereby the idler gear is moveable between the ends of the slot when the bar is aligned with the channel and alternatively locked at either end when the bar is positioned in one of the recesses and rotated out of alignment.

9. The powered wrench of claim 4, wherein the second means for locking comprises an annular slot in each of the hub protrusions, the annular slots positioned to be even with the exteriors of the base and cover parts when shifted thereto, the second means for locking further comprising a pair of latches rotatably mounted to the exteriors of the cover and base parts, wherein each of the pair of latches have positions to alternatively interlock with one of the annular slots positioned adjacent thereto or to disengage to allow the gear stack to shift along the second axis of rotation.

10. The powered wrench of claim 1, wherein the first number of teeth is 60 and the first gear ratio is 60:1.

11. The powered wrench of claim 1, wherein the second number of teeth is 30 and the second gear ratio is 30:1.

12. A method for using the powered wrench of claim 7, comprising the steps of:

connecting a motor to the shaft;

inserting an insert appropriate to a work piece into the socket;

engaging the socket to the work piece;

selecting the first gear ratio by unlocking the idler gear, moving it to the opposite end of the slot, relocking the idler gear in place, unlocking the gear stack at one of the hub protrusions, moving the gear stack along the second axis of rotation to where the first spur gear is enmeshed with the idler gear, and relocking the gear stack at the other hub protrusion in place;

applying power to loosen the work piece;

selecting the second gear ratio by unlocking the gear stack at one of the hub protrusions, moving the gear stack along the second axis of rotation to where the second spur gear is in position to align with the idler gear, relocking the gear stack at the other hub protrusion in place, unlocking the idler gear, moving it to the opposite end of the slot to enmesh with the second spur gear, and relocking the idler gear in place; and applying power to expeditiously remove the work piece.

* * * * *